US005117662A

United States Patent [19]

Holmes

[11] Patent Number: 5,117,662

[45] Date of Patent: Jun. 2, 1992

[54] HELMET LOCKING DEVICE

[76] Inventor: Thomas C. Holmes, R.R. 2, Annapolis Royal, Nova Scotia, Canada, B0S 1A0

[21] Appl. No.: 588,845

[22] Filed: Sep. 27, 1990

[30] Foreign Application Priority Data

Sep. 28, 1989 [CA] Canada ..... 614345

[51] Int. Cl.[5] ..... E05B 73/00

[52] U.S. Cl. ..... 70/59; 2/424; 70/38 C; 70/58

[58] Field of Search ..... 70/59, 38 C, 40, 38 R, 70/38 B, 39.258, 38 A, 49, 58, 30; 2/410, 424, 425

[56] References Cited

U.S. PATENT DOCUMENTS

| | | | |
|---|---|---|---|
| 438,526 | 10/1890 | Butler | 70/40 |
| 459,499 | 9/1891 | Moore | 70/38 B X |
| 1,079,655 | 11/1913 | Lissner | 70/38 C |
| 1,473,353 | 11/1923 | Miller . | |
| 3,436,936 | 4/1969 | Locker | 70/59 |
| 3,529,451 | 9/1970 | McOsker et al. | 70/59 |
| 3,531,955 | 10/1970 | Taylor et al. | 70/59 |
| 3,646,786 | 3/1972 | Baker | 70/59 |
| 3,835,675 | 9/1974 | Lippisch | 70/38 A |
| 3,882,700 | 5/1975 | Dunlap et al. | 70/59 |
| 3,906,758 | 9/1975 | Hurwitt | 70/49 X |
| 4,112,716 | 9/1978 | Wippich | 70/39 X |
| 4,274,271 | 6/1981 | Todd et al. | 70/59 |
| 4,345,447 | 8/1982 | Keung et al. | 70/38 A |
| 4,766,616 | 8/1988 | Donahue | 70/59 X |

FOREIGN PATENT DOCUMENTS

| | | | |
|---|---|---|---|
| 87798 | 7/1896 | Fed. Rep. of Germany | 70/38 C |
| 1933381 | 1/1971 | Fed. Rep. of Germany | 70/30 |
| 2470225 | 6/1981 | France | 70/58 |

*Primary Examiner*—Lloyd A. Gall
*Attorney, Agent, or Firm*—Dressler, Goldsmith, Shore, Sutker & Milnamow, Ltd.

[57] ABSTRACT

A lock for a helmet is disclosed consisting of a lock which is mounted integrally with the liner of the helmet along an edge of the helmet, with the key access and shackle facing outwardly. The shackle is a three-position shackle, capable of being locked in one position such that the shackle extends beyond the periphery of the helmet in order that the helmet may be locked around a suitable object and is lockable in another position such that the shackle is flush with the top face of the body of the lock. An open position of the shackle allows the shackle to swing freely in order that it may engage such a suitable object and the shackle be subsequently locked into the first locked position.

14 Claims, 2 Drawing Sheets

HELMET LOCKING DEVICE

BACKGROUND OF THE INVENTION

This invention relates to a lock for helmet, and in particular for a motorcycle helmet.

Loss of a motorcycle helmet due to theft is a common problem among motorcyclists and bicyclists. In order to prevent such theft, the motorcyclist is obliged to carry the helmet when he or she is dismounted while on journeys away from home. While a helmet is a necessity, it becomes an inconvenience to the operator of the vehicle when not in motion. Consequently, cyclists must have a way of locking their helmet so that it cannot be stolen when left unattended.

Thus, there is a need for a fast, safe and convenient method of securing a helmet to a fixed object, such as a motorcycle, without the aid of a secondary device such as a padlock, chain or cable. Such a method should provide a helmet with a self-contained locking means, which should not affect the safety or change the general appearance of the helmet in any way.

U.S. Pat. No. 4,766,616 (Donahue) discloses a lock for use principally in a bicycle helmet consisting of a shackle locked in a stored position around the top of the helmet and which is locked in an in-use position underneath the helmet in the manner of a chin strap. However, this invention requires modification to the external appearance of the helmet and would not function properly with the majority of motorcycle helmets due to their shape. Furthermore, the shackle is separable from the body of the helmet, requiring to be removed and reinserted in the opposite direction in order to effect locking.

U.S. Pat. No. 3,529,451 (McOsker) discloses a lock for helmet consisting of a removable pin to be inserted through a hole in the helmet and then into a lock which itself clasps the handle bar of a motorcycle. However, the disadvantage of this arrangement is that the lock is made up of two separate pieces, which themselves are not integral with the helmet and thus may be lost.

SUMMARY OF THE INVENTION

The object of the present invention is therefore to provide a lock for helmets which is integral with the body of the helmet and thus is always available for use by the owner of the helmet to lock the helmet in place.

According to one broad aspect of the invention there is provided a lock for a helmet including: lock body means capable of being integrally mounted to the shell of a helmet; shackle means capable of locking engagement with the lock body means and capable of being interchangeably positioned in any of three positions, namely: a first open position wherein the shackle means is free to engage an object, a second locked position wherein the shackle means in cooperation with the lock body means defines a closed aperture confining the engaged object, and a third storage position wherein that the shackle means is substantially confined within the lock body means; and unlocking means which permits repositioning of the shackle means.

BRIEF DESCRIPTION OF THE DRAWINGS

The invention will be further described with reference to the following drawings, in which.

DETAILED DESCRIPTION OF THE INVENTION

Figure 1:
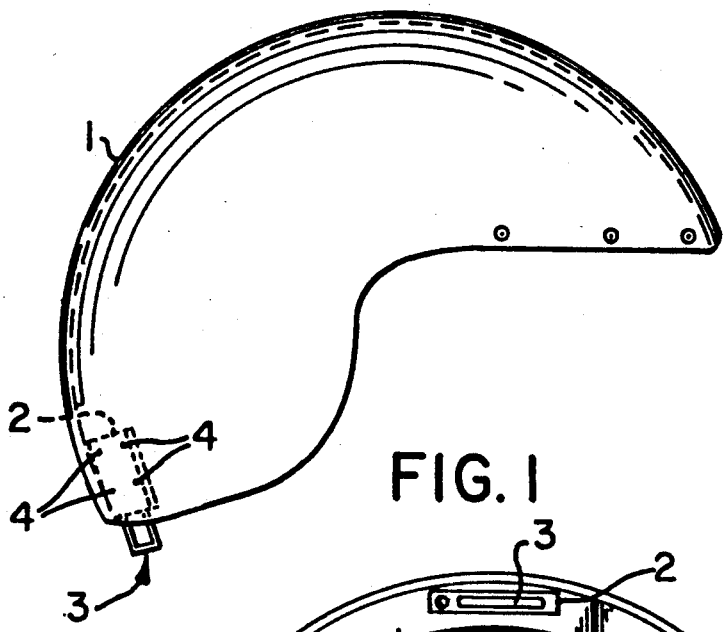
FIG. 1 is a side elevation view of a motorcycle helmet showing the lock in partial perspective.

In the preferred embodiment of the invention, the lock is located inside the shell of the helmet near the rear rim. As seen in FIG. 1, the lock 2 is attached to the helmet body 1 in such a fashion that the shackle 3 projects beyond the lip of the motorcycle helmet when the shackle is not in the locked fully closed position. The lock is secured to the inside of the outer shell by means of rivets 4 which pass through the body of the lock and the shell of the helmet.

Figure 2:
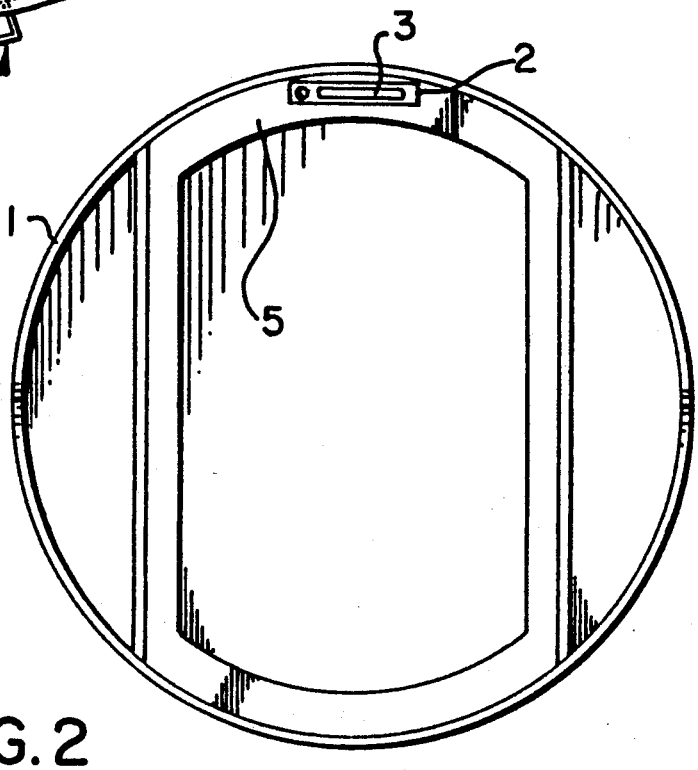
FIG. 2 is a bottom plan view of a motorcycle helmet showing the helmet lock from underneath.
Figure 3:
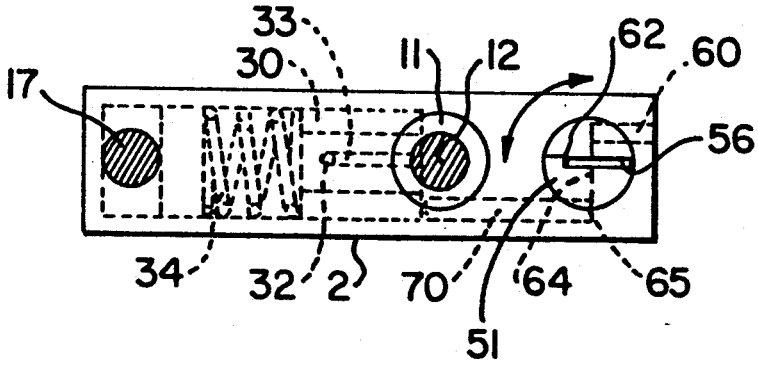
FIG. 3 is a plan view of the lock showing in detail the locking mechanism.
Figure 7:
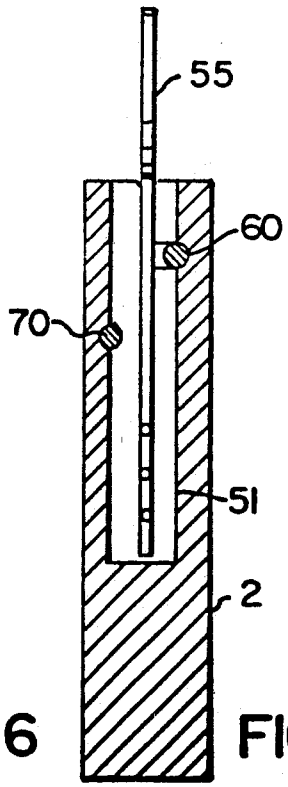
FIG. 7 is an end elevation view of the lock as seen from the other end of the lock showing the key mechanism.
Figure 6:
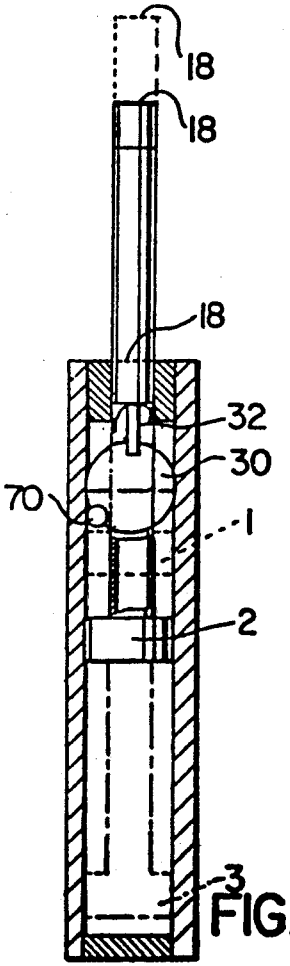
FIG. 6 is an end elevation view of the lock showing the shackle mechanism.

Safety approved liner material 5 (such as high density styrofoam) is installed over and around the lock such that the body of the lock is hidden from view apart from the top surface of the lock from which the shackle projects. Thus, the body of the lock is not an obstruction to the wearer of the helmet and therefore does not interfere with the safety aspect of the helmet if impact should occur. FIG. 2 illustrates this.

Figure 4:
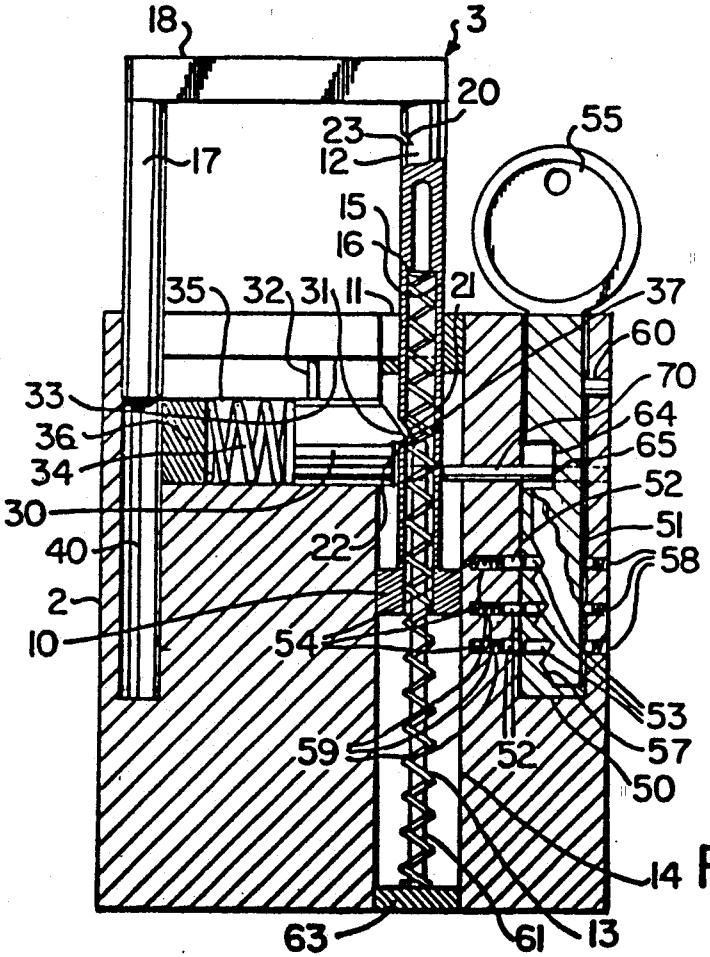
FIG. 4 is a side elevation view of the lock.

FIGS. 3, 4, 5, 6 and 7 illustrate the construction of the lock. Referring to FIG. 4, the shackle has a first open position and two locked positions. The body of the lock would preferably be constructed out of solid brass and would be drilled and machined to accept moving parts made out of hardened steel to ensure a smooth action. The lock would employ a "Yale" (trademark) type pin tumbler locking mechanism.

Shackle 3 has a flange 10 machined onto one leg thereof as shown in FIG. 4. This flange 10 in cooperation with bushing 11 cooperates to prevent leg 12 of the shackle from being drawn out of the body of lock 2. A spring 13 located within a conduit 14 in the body of the lock provides a positive pressure against the shoulder 15 of leg 12 by means of being inserted into a conduit 16 at the base of leg 12. Accordingly, a pressure is always present upon the shackle 3 urging it out of the body of the lock. A guide rod 61 is located within conduit 14 in order to prevent the possibility of spring 13 from binding within conduit 14. The spring is relatively small in diameter and it would otherwise be possible for it to bend over or bind when the leg 12 is pushed into the body of the lock. The guide rod is secured on the plug 63 and protrudes from the centre up into the leg. Thus, the spring is held straight throughout the opening and closing of the lock.

Detents 20 and 21 are provided in leg 12 of the shackle in order to provide a means whereby the shackle may be locked in position. Locking bolt 30 is provided with a catch 31 which is identical in profile to the detents 20, 21. A guide pin 32 is disposed in the top of locking bolt 30, which guide pin is able to move in a lateral direction as seen in FIG. 4 within recess 33. Spring 34 is provided in conduit 35 along with the locking bolt 30 in order to provide a positive pressure on locking bolt 30. Plug 36 provides a backrest against which the force of the spring may be exerted.

Accordingly, in the first open position, flange 10 would abut push rod 70 and locking bolt 30 and leg 17 would be free of the body of the lock, allowing the shackle to swing freely about an axis defined by the centre of leg 12 of the shackle.

Figure 5:
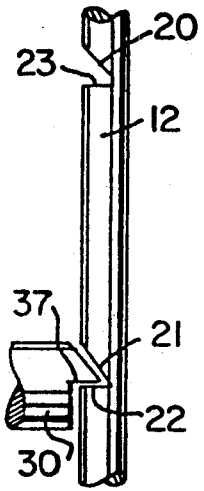
FIG. 5 is a detail view of the engagement of the shackle with the locking bolt.

In the second locked position, leg 17 of the shackle would engage conduit 40 and be pushed down until locking bolt 30 engaged detent 21 of leg 12. At this point, flat face 37 of locking bolt 30 would be in contact with flat face 22 of leg 12 of the shackle, spring 34 ensuring that catch 31 was as fully engaged as possible into detent 21. Flat face 37 in cooperation with flat face 22 would prevent the shackle from being withdrawn from the body of the lock. This is as depicted in FIGS. 4 and 5.

In a third storage position, detent 20 would engage with catch 31, maintaining the shackle in a fully closed configuration with the top surface 18 of the shackle being substantially flush with the top surface of the body of the lock 2. In either locked or storage position, spring 13 would tend to urge shackle 3 upwards, maintaining positive engagement between catch 31 and flat face 22 or 23 of the detents 21 and 20 respectively.

A separate conduit 50 is provided adjacent conduit 14 into which a lock barrel 51 is mounted. The pin mechanism is of standard construction and is of the Yale type of construction. Pin tumblers 53 are disposed within barrel 51 and pin tumblers and springs 52 and 54 respectively are located adjacent conduit 50. When a key 55 is inserted into the opening 56 in the lock, the ridges 57 act to align the tumblers and pins in such a fashion that the barrel 51 may be turned. Plugs 58 may be provided to stopper the conduits 59.

This is illustrated in FIG. 4 which shows all pin tumblers, 52 and 53 in the neutral or open position; that is the key has been inserted and the indents in the key are such that all the tumblers line up and none of them restrict the barrel from rotating in the cylinder or the conduit 50. When there is no key present in the barrel, springs 54 exert pressure onto tumblers 52, which in turn butt against tumblers 53, thus bridging the space between the barrel and the cylinder, preventing the barrel from rotating. When the key is removed from the barrel, the tumblers 53 will come to rest about half way across the key hole. The key has a taper at the end of it so that when the key is inserted into the key slot, it slides the tumblers 53 in the barrel back into the springs which resist the key to a certain extent. When the key is finally pushed all the way 'home', all of the tumblers will be aligned, allowing the key, the barrel and the tumblers 53 to rotate about the axis of the conduit 50. When the barrel is rotated, face 64 of the barrel presses against end 65 of push rod 70, activating the push rod so that it in turn pushes upon locking bolt 30, disengaging catch 31 from detent 21, permitting upward movement of the shackle.

The barrel is held secure in the conduit 50 by means of a rotation stop pin 60. The pin is pressed into the body of the lock where it protrudes through a slot located in the side of the barrel 51. This slot or cutaway has a face 62 that, when rotated 90 degrees, will come to rest at the end of rotation stop pin 60. In this way, the barrel can only be rotated, with the key inserted, in a 90 degree arc in a clockwise movement, as viewed from above key hole 56.

There are several modifications that could be applied to this mechanism. For example; stop pins could be installed so the shackle could only be closed when the leg 17 is aligned with conduit 40. Also, at the same time, the mechanism could be designed so that when the shackle was in the fully open position it could be made to swing out only 90 degrees from the body and would rest at right angles in relation to the rim of the helmet.

Thus, in operation, the shackle 3 is normally kept in a fully engaged storage position with catch 31 fully engaged into detent 20 and the top surface 18 of shackle 3 flush with the body of the lock and thus with the periphery of the shell of the helmet. When it is desired to lock the helmet, the key 55 is inserted into the barrel 51 of the lock and the key turned. This releases the locking bolt 30 from detent 20 and allows the shackle to snap open under the influence of spring 13. The shackle may then be placed around any suitable object such as a handlebar and the leg 17 of the shackle re-engaged into conduit 40 and the shackle closed until locking bolt 30 engages detent 21. At this point, the helmet will be locked around the desired object such as a handlebar and thus made secure from would be thieves. To remove the motorcycle helmet, the key must again be inserted into the keyhole 56 of the barrel 51 and turned, which again releases locking bolt 30 from detent 21, allowing the shackle to snap open under the pressure exerted by spring 13. The shackle may then be swung free and the shackle removed from the handlebar or other object around which it has been locked. The shackle may then be reinserted into conduit 40 and pushed downwardly until locking bolt 30 again engages detent 20 and top surface 18 of shackle 3 is once again flush with the top surface of the lock 2.

The size of the shackle is designed to allow for securing around any convenient spot on the vehicle. As most handlebars are approximately one inch in diameter, the shackle should preferably be sufficiently large to allow for locking in the locked position around objects with a maximum diameter of 1 and ¼ inch. As helmets come in various shapes and sizes, exact location of the lock may differ between helmets. An adapter shim may be necessary in order to install the lock in a given helmet. Such a shim would be located between the inside of the outer shell and the lock itself. One side of the adapter shim would conform to the shape of the body of the lock while the opposite side of the adapter shim would have the same contours as the inside of the helmet.

It should be understood that other embodiments of the present invention which do not depart from the essentials described herein are also covered by this patent.

What I claim as my invention is:

1. A lock apparatus for a helmet including:

lock body means capable of being integrally mounted to an interior surface of a shell of the helmet;

shackle means capable of locking engagement with the lock body means and capable of being interchangeably positioned in any of three positions, namely:

a first open position wherein the shackle means is free to engage an object, a second locked position wherein the shackle means in cooperation with the lock body means defines a closed aperture confining the engaged object, and a third storage position wherein the shackle means is substantially confined within the lock body means; and unlocking means which permits repositioning of the shackle means.

wherein the lock body means is mounted such that the shackle means is adjacent an edge of the helmet and the lock body means and the shackle means are substantially concealed from view within the shell when not in use in the third storage position.

2. The apparatus as claimed in claim 1 wherein the shackle means is subjected to an outward pressure by spring means.

3. The apparatus as claimed in claim 1 wherein access to the unlocking means is located on the same face of the lock body means as the shackle means.

4. The apparatus as claimed in claim 3 wherein access to the unlocking means is offset on the face of the lock body means relative to an area of the face of the lock body means covered by the shackle means when the shackle means is in the third storage position.

5. The apparatus as claimed in claim 4 wherein the shackle means is subjected to an outward pressure by spring means.

6. The apparatus as claimed in claim 1 wherein the shackle means engages the lock body means on a face of the lock body means adjacent the edge of the helmet such that when the shackle means is locked in the second locked position, the shackle means projects beyond the edge of the helmet.

7. A helmet including the apparatus as claimed in claim 6.

8. The apparatus as claimed in claim 6 wherein the shackle means is subjected to an outward pressure by spring means.

9. The apparatus as claimed in claim 6 wherein access to the unlocking means is located on the same face of the lock body means as the shackle means.

10. The apparatus as claimed in claim 9 wherein access to the unlocking means is offset on the face of the lock body means relative to an area of the face of the lock body means covered by the shackle means when the shackle means is in the third storage position.

11. The apparatus as claimed in claim 10 wherein the shackle means is subjected to an outward pressure by spring means.

12. The apparatus as claimed in claim 6 wherein a part of the shackle means is permanently engaged in said lock body means.

13. The apparatus as claimed in claim 12 wherein the shackle means is subjected to an outward pressure by spring means.

14. A helmet including the apparatus as claimed in claim 12.

* * * * *